United States Patent [19]

Hale et al.

[11] 4,052,952

[45] Oct. 11, 1977

[54] HYDRAULIC POWERED TRIM AND TILE APPARATUS FOR MARINE PROPULSION DEVICES

[75] Inventors: David Jerry Hale, Pickett; William B. Mayer; Delhardt K. Kollman, both of Oshkosh, all of Wis.

[73] Assignee: Brunswick Corporation, Skokie, Ill.

[21] Appl. No.: 610,318

[22] Filed: Sept. 4, 1975

[51] Int. Cl.[2] ..... B63H 5/12

[52] U.S. Cl. ..... 115/41 HT; 115/17; 248/4

[58] Field of Search ..... 115/41 R, 41 HT, 17, 115/18 R; 248/4

[56] References Cited

U.S. PATENT DOCUMENTS

| | | | |
|---|---|---|---|
| 2,967,687 | 1/1961 | Glusic | 248/4 |
| 3,181,494 | 5/1965 | Kiekhaefer et al. | 115/41 R |
| 3,434,449 | 3/1969 | North | 115/41 R |
| 3,722,455 | 3/1973 | Carpenter | 115/41 HT |
| 3,915,111 | 10/1975 | Buddrus | 115/41 HT |

FOREIGN PATENT DOCUMENTS

| | | | |
|---|---|---|---|
| 588,464 | 5/1947 | United Kingdom | 248/4 |

*Primary Examiner*—Trygve M. Blix

*Assistant Examiner*—Charles E. Frankfort

*Attorney, Agent, or Firm*—Andrus, Sceales, Starke & Sawall

[57] ABSTRACT

A power trim and shock absorbing system for outboard motors. A pair of combined trim positioning and shock absorber cylinder units are mounted within the side arms of a transom bracket assembly of an outboard motor. A manifold within the assembly coupled the units to a supply within the boat. A hydraulic manifold is pivotally mounted and attached to the lower end of the cylinder units with hose connections directly to lower side ends of the double walled cylinders to maximize the power stroke. The hose system includes passageways formed directly in the lower mounting bolts for the transom side members to minimize fluid leakage areas and damage to the boat transom. Down trim limit cams are pivotally located within the swivel assembly on a rotating rod and cooperate with aligned motor arms to set the minimum trim down position. A trailing bar is pivotally interconnected to the motor unit between the power cylinder units. An over-center control link is coupled to the bar by a spring. The transom bracket assembly is provided with a locking recess which is engaged by the outer end of the bar in the trailing position.

31 Claims, 11 Drawing Figures

10
10

HYDRAULIC POWERED TRIM AND TILE APPARATUS FOR MARINE PROPULSION DEVICES

BACKGROUND OF THE INVENTION

This invention relates to a hydraulic power trim and tilt apparatus for outboard motors and the like.

Outboard motors and the like are pendently mounted to the transom of a boat with a horizontal axis for selective tilt positioning of the lower unit of the outboard motor. The motor is normally tilted upwardly for transport and is trimmed relative to the boat for optimum propulsion. The motor is tilted from the running position for clearance during maintenance and trailering. The speed, and safety of propulsion, are effected by the degree of tilt or trim of the lower unit with respect to the boat and the angle at which the propeller generates its thrust forces.

With the development of high powered outboard motor units and the like various energy absorption systems have also been incorporated in the mounting of the outboard motors to prevent damage to the motor components and to occupants of the boat under power. Thus, if the lower unit strikes an object in the water with the boat moving at any significant speed, the lower unit is mounted to pivot upwardly over the object in order to prevent damaging of the boar and/or motor. Shock absorbing means are provided to prevent the engine from being kicked or thrown into the boat at the time of impace and similarly to absorb the forces during return movement of the motor.

Highly satisfactory combined tilt positioning and shock absorbing piston-cylinder units are disclosed in U.S. Pat. No. 3,434,448 to William Woodfill and U.S. Pat. No. 3,434,450 to Daniel McCormick. As more fully disclosed therein each of the piston cylinder units is provided with a piston having internal valves to permit the combined power actuating trim and tilt positioning while maintaining the shock absorbing characteristics of the assembly.

With the continuously increasing power and general increase in size of outboard motors, the tilt mechanisms are increased in power handling capabilities. The relatively high pressures are required to position and hold the devices in position. Consequently, the hydraulic piping and connections becomes an importance to prevent damage under normal operating conditions. Thus, the damping characteristic of the combined actuating and shock absorbing units may change with flexure of the hose and the like. The size also increases and increases the bulk of the outboard motor appearance. With the increase in weight associated with the larger outboard motors and the like, the angular orientation of the unit to properly tilt the mechanism and absorb the pivoting forces under normal operation require particular considerations to adequately operate over long periods of time.

In addition, the mounting apparatus normally includes mechanical lock mechanisms to lock the outboard motor unit in the raised position for trailing, maintenance and the like. In addition, a mechanical trim limit stop is desirably provided to establish a minimum trim position. A reverse lock is also normally provided to prevent the kicking up of the lower unit out of the water a result of the reverse propulsion forces.

SUMMARY OF THE PRESENT INVENTION

The present invention is particularly directed to a power trim and tilt apparatus for outboard motors and the like having power cylinder positioning means for positioning of the outboard unit, with the power cylinder means mounted in a protective manner beneath the outboard unit to provide protection of the operating apparatus and to improve the appearance of the outboard motor assembly. Generally, in accordance with a particularly novel embodiment of the invention, a pair of combined power actuating the shock absorber cylinder units are mounted within the swivel bracket assembly to provide reliable and positive positioning of the unit and absorbing of the large forces associated with high horsepower motors.

A combined power actuating and shock absorbing cylinder construction is disclosed with minimum input spacing to thereby provide a maximum working stroke for effective positioning of the outboard motor unit. In another aspect and feature, an improved mechanical latch mechanisms is incorporated into the mounting assembly within the swivel bracket assembly for mechanical locking of the apparatus in a raised position. Mechanical stop means is also provided, in accordance with a further aspect of a preferred embodiment, to selectively set the minimum down trim position.

More particularly, in accordance with a preferred and practical embodiment, the swivel bracket assembly includes a pair of side members secured to the boat transom. The motor unit includes a pivot support member pivotally attached to the upper end of the assembly. A power operator pivot support is connected to the lower end of the swivel bracket members. The pair of piston cylinder units have one element pivotally interconnected to the support between the side members and extend upwardly with opposite element secured to upper portion of the outboard unit adjacent to the upper end of the swivel assembly. The cylinder units are powered from the lower end through a hydraulic manifold pivotally mounted between the lower end of the cylinder units. The port or supply connection to cylinder units is further preferably uniquely constructed to the side of the operating portion of the cylinder chamber to minimize the overall length of the unit while maximizing the power stroke. In particular the cylinders are double walled defining the passageway to the upper end of the cylinder which is provided with an internal transfer passageway for carrying of the hydraulic liquid to and from to the upper end of the cylinder. The connection to such passage is made through the side wall adjacent the lower end of the operating internal cylinder. The lifting passageway is immediately adjacent to the lower head with a side wall passageway connecting the hydraulic liquid fluid directly beneath the piston unit.

Further, in accordance with a very significant aspect and practical feature of one embodiment of the present invention, a single pair of hydraulic connections are made to the manifold at the lower end and are connected to a pump unit in a reservoir located within the boat by conduit means integrally formed within the lower transom mounting bolts for the swivel bracket side members. This minimizes the hydraulic plumbing fixtures and eliminates formation of additional openings in the boat transom or dry well through which hydraulic hoses are normally routed. This minimizes the possible points of fluid leakage and of course minimizes the damage to the boat transom. Such bolts are preferably formed as cold headed, stainless steel tubular bolts with hydraulic machined fittings in the opposite end of the opening. A hydraulic pump and a reservoir is connected to the inner of the two tubular bolts and a transfer hose assemblies connected to the outer end of the bolts to the input ports of the manifold. The hose assemblies extend around the back side of the cylinders and into the manifold, which has paired outputs ports connected to the adjacent internal sides of the lower cylinder heads. This maintains maximum closure of the exterior portion of the hydraulic fittings while creating a compact, neat appearing assembly.

The mounting of the power cylinder units within the swivel bracket assembly minimizes the available space for the mechanical for adjusting the minimum down trim position and/or providing for locking of the outboard unit in the raised transport or trailering position. In accordance with the further aspect and feature of this invention, the down trim limit stop means includes pivotally mounted cam plates located within the swivel assembly. A preferred embodiment is disclosed including a rotating rod pivotally mounted in the swivel bracket to the inner side of the hydraulic cylinder units. A pair of stepped cams are secured to the rod immediately adjacent to the inner wall of each of the swivel bracket side members and cooperate with corresponding adjacent motor unit arms to limit the trim down positioning.

A unique trailer locking assembly is located between the cylinder units and includes an arm or bar member pivotally interconnected to the motor unit between the power cylinder units. A control link means is coupled to the bar member by a resilient means which is oriented to define an over center type linkage. A locking bracket is provided with a locking recess which is engaged by the outer free end of the bar with the engine in the raised tilted position. In the lowered position, the bar lies adjacent the swivel bracket between the power cylinder units. In both positions, the over center linkage maintains the locking bar in the set position. The bar cannot inadvertently or accidently fall forwardly or downwardly if the engine should tilt upwardly slightly and disengage the end of the bar from the latch recess. Both positions require positive actuation of the actuating or control link means to release the latch bar and permit movement of the outboard unit between the down and the up positions.

The present invention has been found to provide improved power actuating and shock absorbing mount assembly for high powered motors and the like and particularly to provide a compact and neat appearance of outboard motors. In its various aspects the assembly includes improved mechanical linkages for controlling the positioning of the outboard motor unit.

BRIEF DESCRIPTION OF THE DRAWINGS

The drawings furnished herewith illustrates a preferred construction of the present invention in which the above advantages and features are clearly disclosed as well as others which will be readily understood from the following description.

In the drawings.

DESCRIPTION OF THE ILLUSTRATED EMBODIMENT

Figure 1:
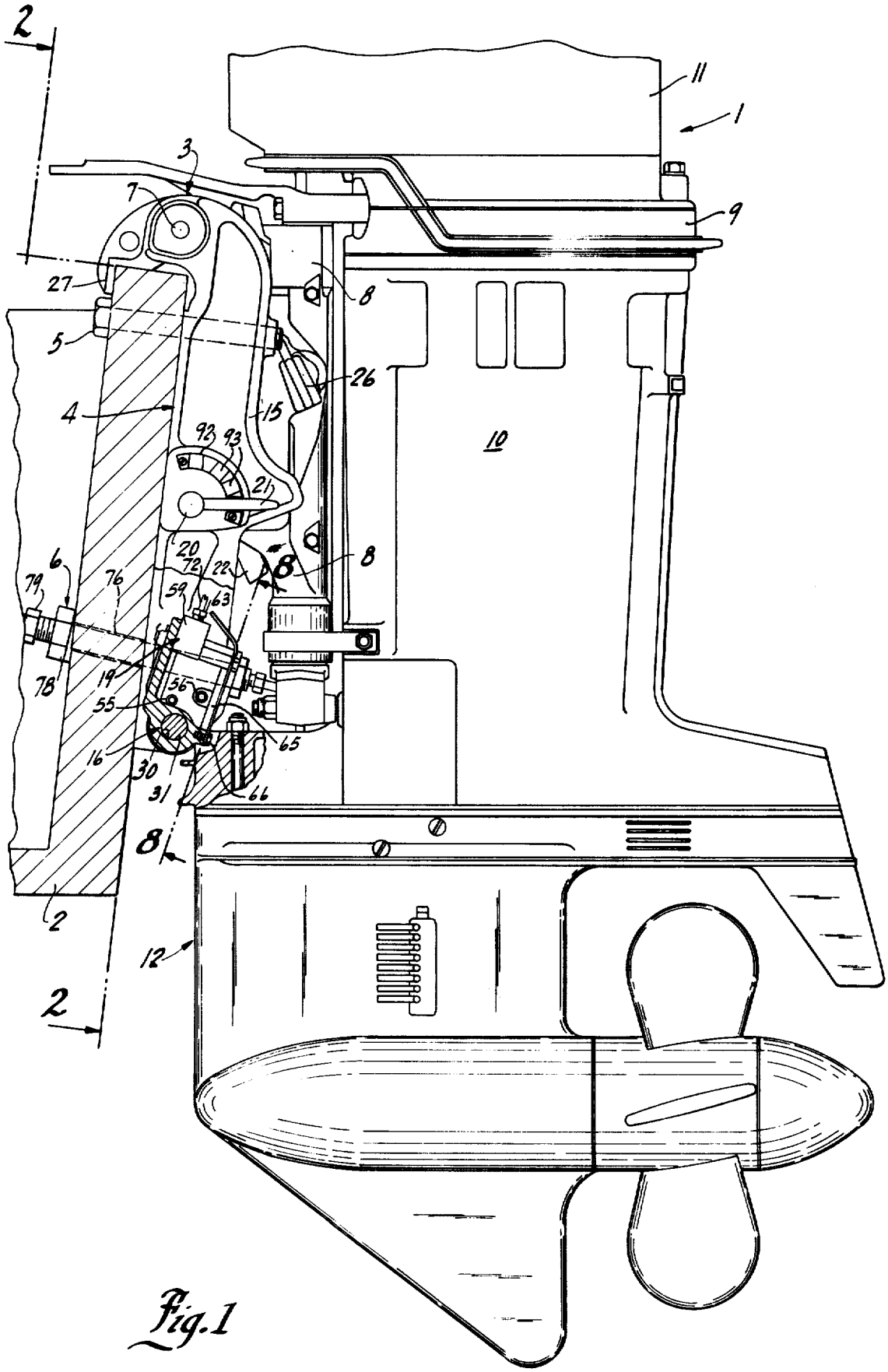
FIG. 1 is a fragmentary side elevational view of an outboard motor unit illustrating the swivel bracket assembly mounting of an outboard motor in a first trim position.
Figure 2:
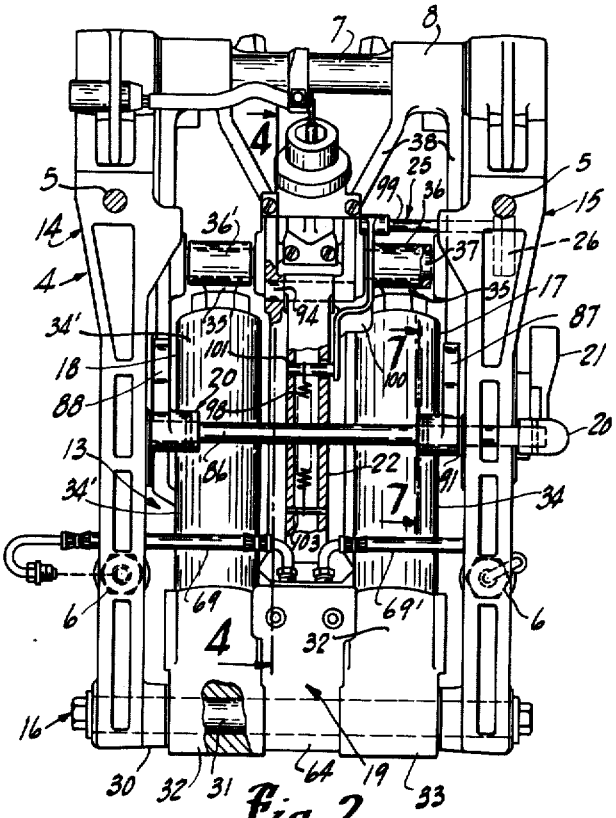
FIG. 2 is a view taken along generally one line 2 - 2 of FIG. 1 and illustrating the mounting of the trim and tilt apparatus for positioning of the outboard motor with respect to the swivel bracket assembly.
Figure 7:
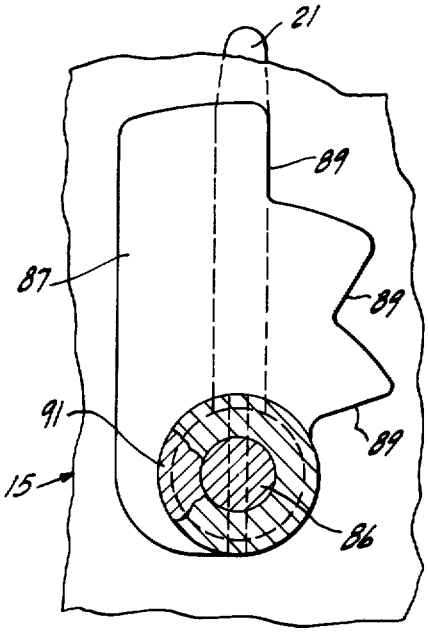
FIG. 7 is a vertical section taken generally on lines 7 - 7 of FIG. 2 more clearly illustrating the trim limits mechanical mechanism to limit the down trim positioning.
Figure 8:
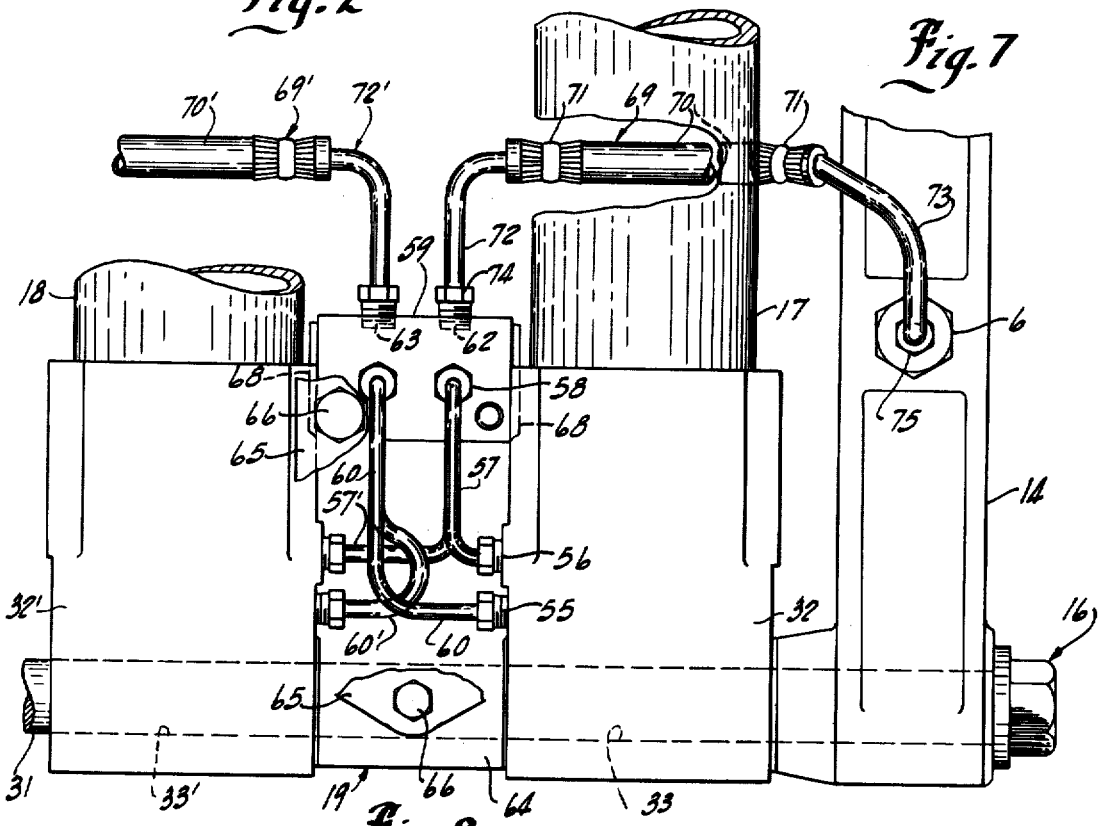
FIG. 8 is a sectional view taken generally on line 8 - 8 of FIG. 1 to more clearly illustrate a hydraulic manifold and line connection to the combined power actuating and shock absorbing units.

Referring to the drawing and particularly to FIGS. 1 and 2, a fragmentary portion of an outboard motor unit having an outboard motor 1 illustrated mounted to the transom 2 of a boat, not otherwise shown, by a bracket mounting assembly 3 for tilt and swivel position of motor 1 relative to the boat. The assembly 3 includes a clamp bracket 4 which is adapted to be releasably secured as by upper bolts 5 and lower bolts 6 to the transom 2. The bracket 4 includes a portion extended over the upper end of the transom 2 with a pivot or tilt shaft 7 mounted therein and generally overlying the upper end of the transom. The outboard motor 1 includes a swivel support bracket or member 8 which is a generally U-shaped member interconnected with the upper wall structure 9 of the motor drive shaft housing 10, upon which a powerhead 11 is secured. Member 8 is pivotally mounted on the shaft 7 for selective tilting of the outboard motor 1 about such shaft 7 for trimming under operating conditions and for trailering.

The outboard motor apparatus includes a suitable lower propeller unit 12 secured to housing 10 and motor 1 is pivotally mounted to the swivel bracket assembly 3 with a vertical steering axis and the like not shown. The present invention is particularly directed to a unique combined tilt actuating and shock absorbing power cylinder means 13 mounted within the bracket assembly 3 in alignment with the motor 1 and particularly housing 10 and to interconnection thereof to the motor 1 for selective and controlled positioning of the outboard motor 1 relative to the assembly 3 and therefore boat transom 2. Consequently, the detail of other components of the outboard motor such as the power head, the lower propeller unit and the like are not described in any further detail. Their construction may be of any suitable or desirable known construction.

Figure 3:
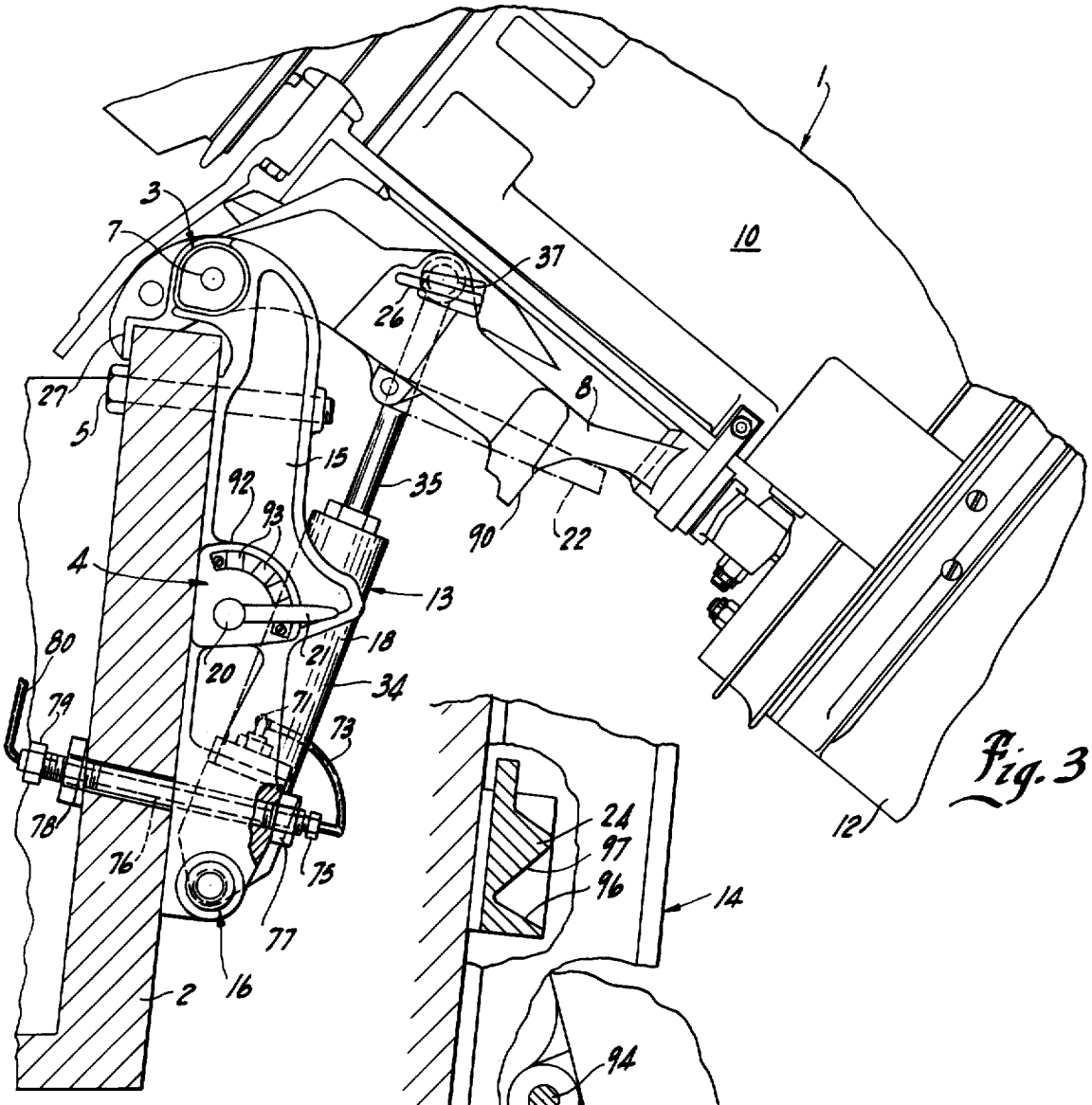
FIG. 3 is a view similar to FIG. 1 illustrating the outboard motor angularly displaced upwardly and rearwardly to a second trim or tilt position.

Generally, in the illustrated embodiment of the invention, the bracket assembly 3 includes relatively heavy vertical side members 14 and 15 similarly interconnected at the upper end by the swivel shaft 7 and associated end attachment means and at the lower end by a trim shaft mounting assembly 16. The members 14 and 15 are relatively heavy high strength elements which extend downwardly and in bearing engagement with the transom 2 and project outwardly toward motor 1. The novel positioning mechanism 13 is located between the members 14 and 15 and includes a pair of combined power actuating and shock absorbing piston-cylinder units 17 and 18 pivotally mounted and in side-by-side relation between the members 14 and 15 on the trim mounting assembly 16. The units 17 and 18 extend upwardly in parallel relation, with the upper end thereof pivotally interconnected to the swivel bracket 8. The piston cylinder units 17 - 18 in the lower most trim position of the outboard motor extend generally downwardly and vertically immediately adjacent and between the side arms. An hydraulic pump means as a source and a reservoir, not shown, are normally mounted within the boat and coupled through a hydraulic hose system to actuate power units. In the illustrated embodiment of the invention, a hydraulic manifold unit 19 is located immediately adjacent and between the two lowermost ends of the cylinder unit 17 and 18 and connected through a unique hose system to selectively provide hydraulic fluid for powered raising of the outboard motor 1 to an upward trim position, such as shown in FIG. 3, and returning thereof under power to the position shown in FIG. 1. Under operating conditions, the motor 1 will be variously angularly tilted or trimmed with respect to the transom 2 for optimum speed and safety. In the illustrated embodiment of the invention, a unique mechanical limit means 20 is also provided within assembly 3 with a port located handle 21 for selectively establishing a minimum down trim position. For trailering and maintenance, the motor 1 may be raised upwardly to a relatively high position to properly distribute the weight and also to establish clearance for convenient access to the underside of motor 1 and the like.

Figure 5:
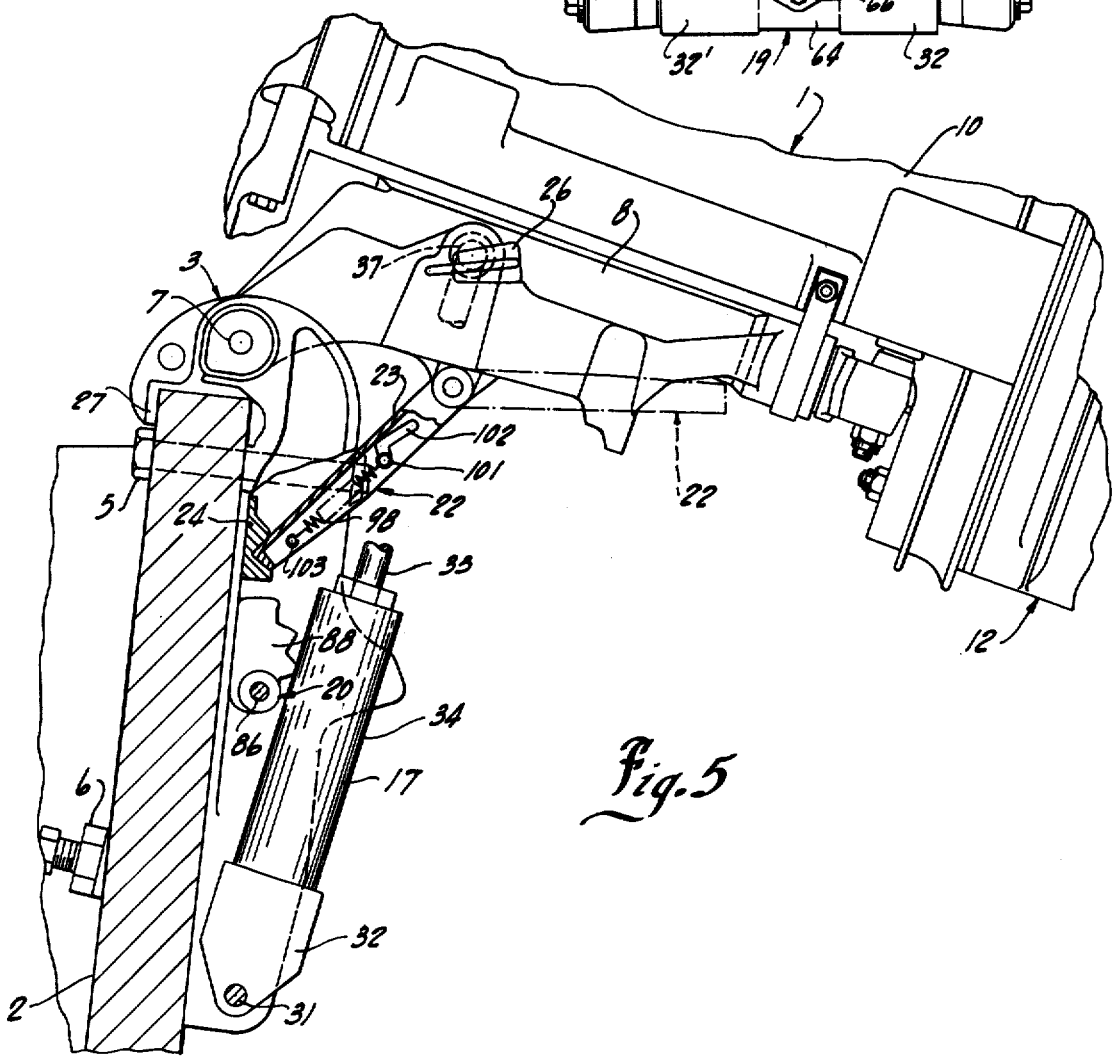
FIG. 5 is a view similar to FIG. 4 showing the outboard motor mechanically latched for trailering.

In the illustrated embodiment, an unique latch trailer lock mechanism 22 is located between the cylinder units 17 and 18 and includes a locking lever or bar 23 for selectively locking of the outboard motor in the raised position. The bar 23 is adapted to be angularly oriented with an outer free end engaging a bracket 24 abutting the transom 2 as shown in FIG. 5. Bar 23 is constructed with a resiliently loaded over-center latch means to establish two alternate stable positions. A release linkage means 25 includes an operating handle 26 for positively moving the bar from the set position.

Thus, as more clearly shown in FIGS. 1 and 2, the hydraulic positioning and shock absorbing mechanism as well as the mechanical latching mechanisms, except for the exposed operating handles are conveniently located within the confines of the side swivel bracket members 14 and 15. The power cylinder units 17 - 18 are symmetrically located to the opposite sides of the swivel bracket assembly 8 and ahead the outboard motor 1. The embodiment thus provides a compact mounting outboard motor positioning and protective means located to provide an improved overall appearance of the outboard apparatus with reliable actuation and positioning of the motor 1. The location of the mechanisms further contributes to maintaining a protective enclosure of the working components in the propulsion position while also providing convenient and readily exposing of the mechanisms for maintenance and the like.

More particularly, in the illustrated embodiment of the invention, each of the piston-cylinder units 17 - 18 is identically constructed and the unit 17 will be described in detail, with the corresponding elements of the opposite piston-cylinder unit 18 identified by corresponding primed numbers.

Thus the swivel bracket assembly 8 and particularly the side arms or members 14 and 15 are relatively massive and strong castmetal elements having vertically spaced bolt openings for bolted attachment of the swivel bracket assembly to the transom 2 with hook portion 27 resting on the upper edge of the transom. The upper bolts 5 are any suitable conventional bolt members. The lower bolt members 6 of the illustrated embodiment of the invention are specially constructed to form an integral part of the hydraulic hose system, as more fully developed hereinafter.

The upper end of the members 14 and 15 are provided with suitable bosses for the tilt shaft 7. The lower ends of the members 14 and 15 are constructed with lateral bosses or journals 30 in which the trim mount shaft 31 of assembly 16 is secured. The shaft 31 is secured to assembly 3 by suitable lock nuts on the opposite ends of the shaft. The piston-cylinder units 17 - 18 include a lower cylinder head 32 with an integral pivot journal 33 which is pivotally mounted on the shaft 31.

The piston cylinder 34 extends upwardly therefrom with a piston rod 35 extending outwardly from the upper closed end of the cylinder 34. The outer end of rod 35 terminates at the outer end in a pivot bushing 36 mounted on a pivot pin 37 secured within side arms or portions 38 of the engine swivel bracket 8 to pivotally attach the upper end of the piston cylinder units 17 and 18 to the motor 1.

As shown in FIGS. 1, 2, 8, and 9, piston-cylinder units 17 and 18 are powered to position a piston unit 39 and thereby the piston rod 35 by supplying of hydraulic fluid to the opposite sides of the piston unit 39 through the manifold unit 19 adjacent the lower heads 32 and 32'. The lower end of the cylinder 34 is closed by head 32 which threads thereon, while the upper end is formed with an integral end wall 40 within which rod 35 is slidably mounted. The cylinder 34 is a double wall assembly including an inner cylinder liner or jacket 41 spaced inwardly of the cylinder 34 to define a transfer passageway 42 between opposite ends of the cylinder unit. The liner 41 is formed with a plurality of circumferentially spaced side wall protrusions 43 which are machined to abut the inner wall of cylinder to accurately locate the liner and define the passageways 42 therebetween about the cylindrical piston chamber 44 formed by liner 41. The outer end of liner 41 is clear of the protrusions and abut a washer 45 adjacent the inner surface of wall 40. Washer 45 has peripheral slots 46 defining passageways from transfer passageway 42 to chamber 44 and particularly by the rod side thereof. A bleed opening 47 in wall 40 is closed by a cap screw 48.

The lower or opposite end of liner 41 extends beyond the corresponding end of cylinder 34 within head 32 and into a corresponding shaped opening 49. Head 32 is threaded on cylinder 34 with the base edge 50 of opening 49 abutting the end of the cylinder liner 41 and with a washer therebetween. The base of the threaded portion is spaced from the end cylinder 34 to form a lateral annular passageway 51 to transfer passage 42 and the base of the liner opening is recessed to form a bottom inlet passageway 52 immediately adjacent the inner most position of the piston unit 39. The sidewall of the head 32 includes lateral or radial supply ports 53 and 54 aligned with passageways 51 and 52 and terminating at the end in threaded openings for receiving similar hose fittings 55 and 56 which are connected to manifold unit 19. The supply ports 53 and 54 are thereby closely spaced to the cylinder chamber 44 and the pivot bushing 33 is also closed spaced to the lower end.

The upper end of the cylinder unit 17 with the integral head wall 40 conjointly with the lower head 32 thus minimizes the overall length of the cylinder unit 17 and creates a maximum operating or working stroke of piston unit 39 and rod 35. This is a significant structure where the placement of combined power tilt and shock absorbing units is within the swivel bracket assembly in order to establish a highly satisfactory tilt positioning and shock absorbing stroke of the units. This structure therefore provides a very compact assembly while maintaining reliable high powered positioning of the assembly. Further, the lower head construction permits a very convenient and protective connection of the hydraulic input/output lines or hoses through a manifold unit 19, as most clearly shown in FIGS. 1, 2, and 8.

A supply conduit 57 terminates at one end in one side wall fitting 56 of the lower head 32 and at the opposite end in fitting 58 secured to manifold 59 of unit 19. Conduit 57 thus conducts hydraulic fluid into and from the passageway 42 defined by the spaced tubular inner liner 41 and outer wall 34.

The second supply hose unit 60 includes fitting 55 and similarly connects the inlet 52 to manifold 59 for conducting hydraulic liquid to and from the lower end of the cylinder chamber 44 to the cylinder side of piston unit 39.

Similar conduit units 57′ and 60′ simultaneously conduct hydraulic fluid to cylinder unit 18, with separate but identically function ports in manifold 59 which includes a set of common ports 62 and 63 for connection to a pressurized supply.

Manifold 59 is a suitable block-like housing mounted between the lower piston heads 32 and 32′. A pivot bracket 64 shown integrally formed with the manifold is pivotally mounted on the shaft 31 between the lower head 32 to pivotally support manifold 59 for movement with cylinder units 17 and 18. The manifold input ports 62 and 63 are located on the upper wall thereof with front wall ports connected by rigid conduits 57 and 60, head 32 and bottom ports similarly connected by the conduits 57′ and 60′ head 32′. Thus the manifold provides for parallel supply of the fluid to the appropriate end of the piston cylinder unit for simultaneous lifting and lowering of the outboard motor for supplying of the hydraulic fluid to the appropriate end thereof.

A front cover 65, shown as a sheet-like metal member, is secured to the pivot support hub 64 and to manifold 59 by suitable screws 66, with the upper end extending inwardly over the manifold connections 57 – 63. The edges of cover 65 project over flattened walls on heads 32 and 32′ as at 67 and the back wall of manifold 59 similarly projects over the heads 32 and 32′ as at 68 to clamp the manifold assembly to heads 32 and 32′ for simultaneous movement with the hydraulic connection in protective relationship between the manifold and the cover.

The ports 62, 63 of the manifold 59 are connected by similar hydraulic hose units 69 to the lower transom bolt units 6, and the unit connected adjacent unit 17 is described. In particular, a flexible hydraulic line or hose 70 is interconnected at the opposite ends as by suitable crimping 71 to rigid conduits 72 and 73, conduit 72 is an L-shaped member terminating in a threaded connector or fitting 74 to the corresponding manifold 62. The flexible hose 70 extends around unit 17 to conduit 73 which is appropriately shaped to terminate in a fitting 75 secured to the outer end of the transom mounting bolt 6. The opposite hose 70′ is similarly constructed and connects port 63 to the lower transom mounting bolt 6 to the opposite side of swivel assembly 4.

Bolt 6, as shown most clearly in FIG. 3, is a tubular bolt member defining a passageway 76 and having an outer clamping head 77 abutting bracket member 15. Head 77 is internally threaded to receive the threaded fitting 75 and thereby interconnecting of the manifold port 62 to the bolt passageway 76. The bolt 6 extends through the transom 2 and has its inner end projecting inwardly of a clamping nut 78. The inner end 1 of bolt 6 is reduced and appropriately threaded to receive a corresponding tubular fitting 79. A hydraulic supply line 80 within the boat terminates in fitting 79 and is connected to the pump and the reservoir, not shown, for selective supply of and return of the hydraulic fluid for pressurized extension and retraction of the piston-cylinder unit 17 with corresponding raising and lowering of the outboard motor.

Figures 9, 10, 11:
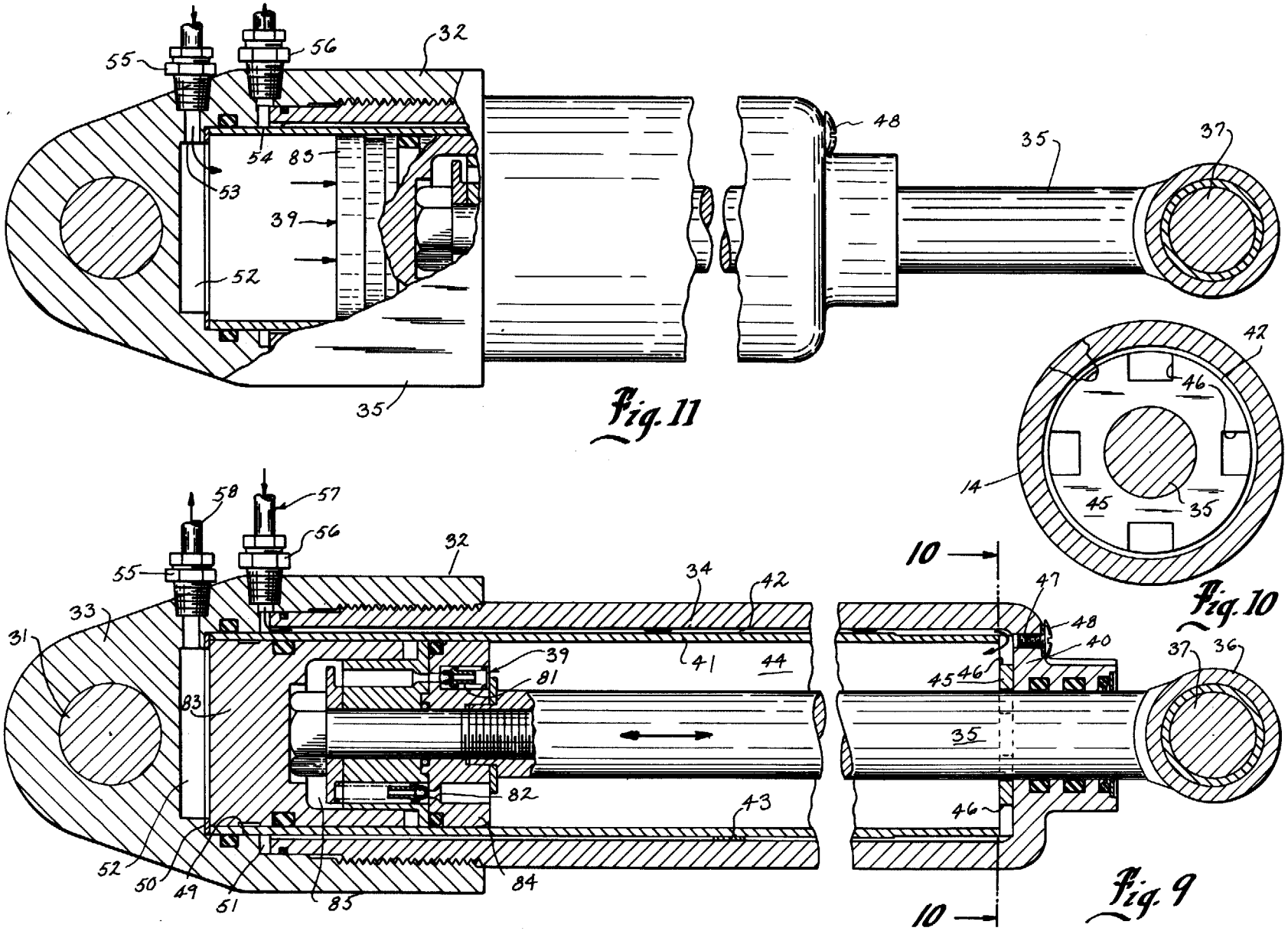
FIG. 9 is a longitudinal section to one of the hydraulic combined power actuating and shock absorbing piston-cylinder unit of the illustrated of the invention.
FIG. 10 is a transverse section generally taken on line 10 - 10 of FIG. 9.
FIG. 11 is a view similar to FIG. 9 illustrating the power cylinder units in the tilt or trim positions.

The piston-cylinder units 17 and 18 are provided with similar piston units 39 with internal suitable valve means 81 and 82 as shown in FIGS. 9 and 11 to function as shock absorbing means for absorbing of the shock forces encountered by the motor 1 and particularly the lower unit 12. Thus, if the lower unit 12 should strike an object in the water, the motor 1 will pivot upwardly, with a rate dependent upon the speed of propulsion. Upon moving over the object, the motor 1 drops and if not supported may drop violently. The valve means 81 and 82 function to produce a control movement to safely support the motor. The illustrated piston unit 39 includes an outer cup-shaped floating head 83 with a piston rod head 84 having a portion telescoped into head 83. Head 84 is clamped to the inner end of rod 35 and provided with the check valve means 81 and 82. Under impact conditions, head 84 moves outwardly of head 83 to introduce a trim memory chamber 85 into the system.

The hydraulic supply system is preferrably constructed in accordance with the copending application of William B. Mayer entitled "HYDRAULIC POWER TRIM AND POWER TILT SYSTEM SUPPLY" which was filed on the same date as this application with Ser. No. 610,415, and filing date of Sept. 4, 1975 and is assigned to the same assignee.

Figure 6:
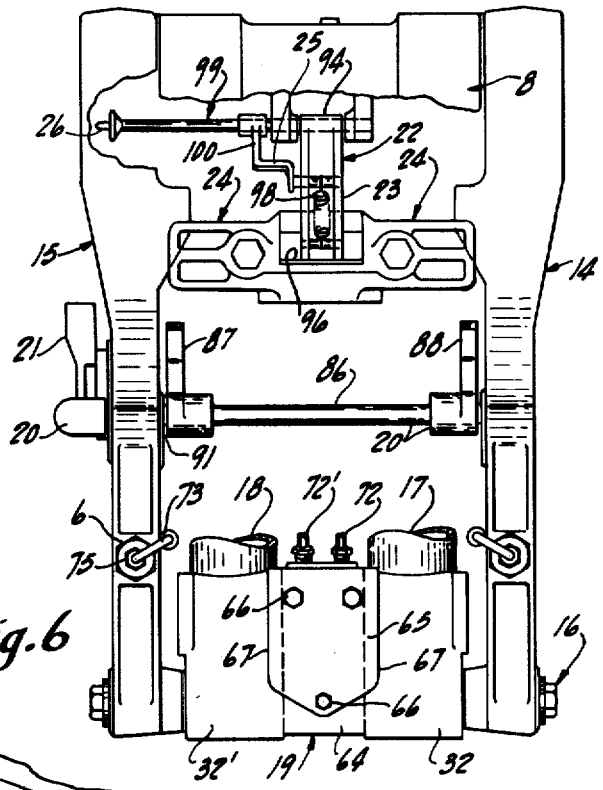
FIG. 6 is a rear elevational view showing the outboard motor in the latched position with parts broken away to more clearly illustrate the latch mechanism.

Generally, means to limit the minimum trim position of the outboard motor 1 are provided. In the illustrated embodiment of the invention, the trim limit means 20 is located within assembly 4 and is a simple cam arrangement. A cam shaft 86 extends between the swivel side members 14 and 15, with the one end of the shaft 86 rotatably mounted within the member 14, and the opposite end of the shaft journaled in and projecting through member 15. The cam positioning lever arm or handle 21 is pinned or otherwise secured to the outermost end of the shaft 86. The shaft 86 is located generally centrally of the vertical length of the swivel bracket assembly 4 and lies behind the cylinder unit 17 and 18 which extend upwardly and outwardly to the outboard motor to provide ample clearance for the cam shaft. Similar, cam trim stops 87 and 88 are pinned to the shaft 86 immediately adjacent to the interior surface of the swivel side members 14 and 15 to pivot with shaft 86 outwardly between the swivel arm member and the adjacent piston-cylinder unit 17 or 18. Thus, the cylinder units are spaced inwardly slightly from the side members and provide ample clearance for the trim stops. As most clearly illustrated in FIG. 6, trim stop 87 is shown with a stepped edge defining a plurality of parallel stop walls 89. The outboard motor 1 includes a stop or abutting member 90 (shown in FIG. 3), aligned with the cam 87 and engaging the aligned stop wall 89 when returned to the lowermost position.

The outer handle or lever 21 has its inner surface abutting the exterior wall of the side member 15, with a resilient engagement thereof resulting from the action of a wave spring 91 located between cam stop 87 and member 15. A latch member 92 is secured to member 15 with a plurality of spaced radial detents 93 arranged in accordance with the stepped surface 89 of the cam stop 87. The lever 21 is selectively positioned and placed in detent 93 and correspondingly aligns a different portion of the stepped walls 89 with the motor abuttment 90. This provides a simple, reliable and inexpensive trim limit control.

Further, in the illustrated embodiment of the invention the latch arm mechanism 22 is provided to positively hold the tilted motor 1 in the trailing position.

Generally, the trailer locking mechanism 22 includes the locking arm or bar 23 which is pivotally secured to the outboard motor 1 and particularly bracket 8 on a pin 94 staked to the mounting bracket 8 immediately beneath the piston rod pivot pins 37. The bar 23 generally depends from the outboard motor 1 and terminates in an outer cam end 95 which is adapted in the raised position to engage the stop bracket 24 which may be rigidly affixed as a part of the swivel assembly 3. The illustrated stop bracket 24 is bolted or otherwise secured to the swivel members 14 and 15 and extends therebetween immediately above the cam shaft 20. The central portion of the bracket 24 is provided with a locking recess 96 having an inclined wall 97, complementing the inclined wall defined by the latching end 95 of the arm 23. The arm 23 is adapted to be extended from the raised motor downwardly toward and into engagement with the bracket recess 96 to form a mechanical over-center support, as shown in FIG. 5.

Figure 4:
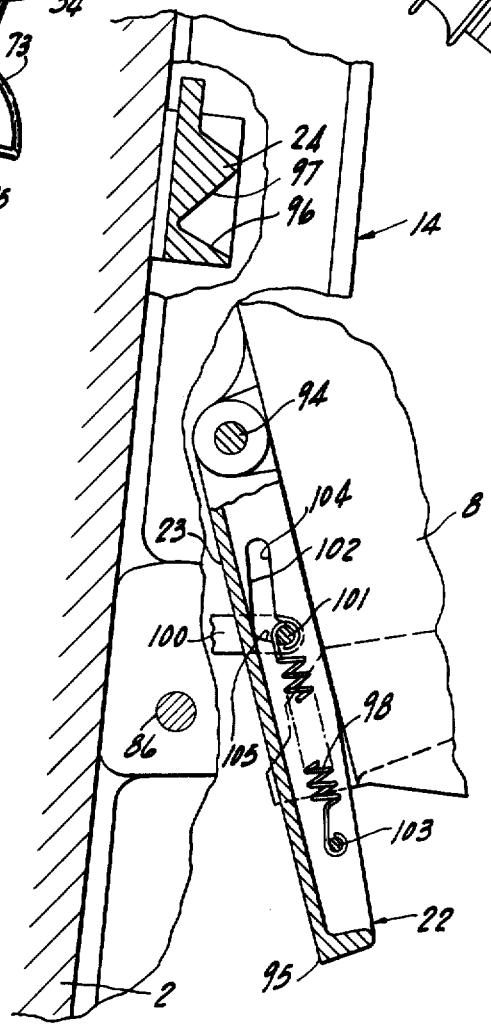
FIG. 4 is a vertical section taken generally on lines 4 - 4 of FIG. 2 and more clearly showing the mounting of combined positioning and absorbing cylinder units and the associated mechanical latching or locking mechanisms.

The latch arm 23 is coupled to the actuating linkage 25 with an interconnecting spring member 98 for developing an over-center type linkage which positively requires positive release of the arm from the latch position shown in FIG. 4, which is automatically established by full tilt. Generally, the actuating linkage 25 includes an actuating shaft 99 which is pivotally mounted within the motor bracket 8 adjacent the upper portion thereof and projects outwardly through side member 15. Release lever 26 is pinned to shaft 99 for positively releasing movement of a latch lever 100 pinned to shaft 99. Lever 100 is a plate-like member extending downwardly to one side of the latch bar 23 and terminating adjacent the side thereof. Bar 23 is shown having a generally U-shaped cross-section. A latch pin 101 extends from the outer end of the lever 100 through a generally L-shaped openings 102 in the side walls of the U-shaped bar 23. Coil spring 98 is secured between to inner portion of the latch pin 101 and to a fixed pin 103, staked within the outer end of the U-shaped bar 23 as more clearly shown in FIG. 2.

The L-shaped slot or opening 102 as shown in FIG. 4 includes a relatively long slot portion 104 extending longitudinally of the latch bar and a relatively short offset portion 105 extending angularly from the long portion and located toward the outer end or free end of the latch bar 23. In the down position, the spring member 98 loads the pivotally mounted pin and lever 100 into the short slot portion 105. This locks the bar 23 in the down position. After the motor 1 is rotated upwardly, the lever 26 is rotated to swing lever 100 and pin 101 outwardly, extending the spring 98 and moving the pin into the longitudinal extension of the slot 102 of the latch arm. The pin 102 moves upwardly to the opposite ends of the long slot portion and thereby effect overcenter latching of the arm 23 in the extended position. In this position, the latching end is of course aligned with the stop plate recess 96 to positively support the outboard motor 1 in the raised position. The overcenter latching as shown in FIG. 4 results in a positive positioning of the latch bar or arm 23 for support of the engine during trailering, maintenance and the like. The arm 23 cannot therefore drop under its weight and requires positive rotation of release lever 26 to lower the motor 1.

Thus, the present invention includes a compact mounting for the tilt and lock mechanism within the swivel bracket assembly for outboard motors and the like, which also provides a protected and asethetically pleasing support. Further, latching mechanism may be provided to maintain a reliable positioning of the outboard motor while maintaining highly safe shock absorbing operating conditions. The mechanism is also readily exposed for maintenance service and the like with an extremely reliable and compact hydraulic system.

Various modes of carrying out the invention are contemplated as being within the scope of the following claims, particularly pointing out and distinctly claiming the subject matter which is regarded as the invention.

I claim:

1. An outboard motor apparatus comprising a clamp bracket means, an outboard motor pivotally attached to the upper end of said bracket means and having a drive shaft housing extending in the rearof said bracket means, and a plurality of combined power trim actuating and shock absorbing piston-cylinder units mounted to the front of and in alignment with said housing between the bracket means and housing, each of said piston-cylinder units having a cylinder member and a piston member mounted in said cylinder member with a piston rod member extending outward, one member pivotally attached to said motor, the opposite member pivotally attached to the bracket means, each of said piston-cylinder units having shock absorbing means, and a hydraulic supply connection means connected to said shock absorbing piston-cylinder units to selectively position and hold the outboard motor in any one of a plurality of angular positions relative to said bracket means for trim positioning of the outboard motor during propulsion, said hydraulic supply connection means including a manifold coupled to and moving with said piston-cylinder units, said manifold having a plurality of supply ports connected by interconnecting passageway means within the manifold to a plurality of output ports, means for connecting the supply ports to a supply of hydraulic fluid, and means connecting said output ports to said piston-cylinder units for supplying a hydraulic fluid to said piston-cylinder units.

2. In the apparatus of claim 1 wherein tubular bolt means secure the bracket means to the transom of a boat, said piston-cylinder units include port connections connected to the output ports of said manifold and said means for connecting said supply ports to the supply of hydraulic fluid including a flexible hose means having rigid end conduit means terminating in connectors attached to the manifold supply ports and to the tubular bolt means.

3. In the outboard motor apparatus of claim 1 having a trailer latch member pivotally secured to the outboard motor and located between said piston-cylinder units and movable between a trailering position and a release position.

4. The apparatus of claim 1 wherein each of said piston-cylinder units includes a double wall cylinder defining a piston chamber and having an inner and an outer wall means spaced to form a transfer passage between said wall means, a supply closure head secured to one end of said cylinder and having a first radial supply port connected to the transfer passage, the outer end of the cylinder having an outer head mounted on the outer wall means of the cylinder having lateral passages between the transfer passageway and the piston chamber at the inner face of said outer head, a second radial supply port in said supply closure head having a lateral passage at the inner face of said supply closure head, and said piston member being a valved piston unit in said piston chamber having said piston rod extended through a sliding seal means in said outer head to provide a maximum working stroke.

5. In the outboard motor apparatus of claim 1 wherein said bracket means includes a pair of vertical side bar members and including a trim stop means pivotally located between said side bar members, said stop means including a stepped edge including different sized steps and including a positioning lever to the exterior of one side bar member for selective positioning of the stop means with one of said steps in the path of the outboard motor.

6. The apparatus of claim 5 wherein said stop means are plates located adjacent sides of the clamp bracket means.

7. An outboard motor mounting apparatus, comprising a bracket means having a pair of vertical side bar members connected at the upper end by a motor pivot assembly for pivotally supporting a motor, a plurality of piston-cylinder power and shock absorbing means, each having a cylinder element and a piston rod element, and a bracket pivot support means including a pivot shaft means secured to the lower end of the side bar members and connected to one of said elements, the other of said elements having pivotal support means adapted to be secured to said motor adjacent the upper end of the side bar members, and a hydraulic manifold unit pivotally mounted on the bracket pivot support means between the lower ends of the elements and having a pair of supply ports and a plurality of pairs of output ports connected to said cylinder elements.

8. In the apparatus of claim 7 wherein said element connected to said bracket pivot support means is a cylinder element, and said manifold unit is attached to an adjacent cylinder element.

9. In the apparatus of claim 7 wherein said element connected to said bracket support means is a cylinder element and said manifold unit includes a pivot bracket mounted on said pivot shaft means and extending upwardly between a pair of cylinder elements, said manifold unit is secured to the upper end of the pivot bracket, a cover releasably secured to the manifold unit to one side of the cylinder elements to define a housing portion, rigid hydraulic connections between the manifold unit and the cylinder elements within said housing.

10. In the apparatus of claim 9 wherein said pivot bracket and said cover includes laterally extending clamp edges overlying the cylinder elements and clamping said cylinder elements therebetween for simultaneous and corresponding pivotal movement.

11. The apparatus of claim 7 having tubular mounting bolts for said side members, hose means connected one between said supply ports and the outer end of each of said tubular mounting bolts, and a pump means and a reservor connected to the inner ends of said bolts.

12. In the apparatus of claim 11 wherein said hose means include rigid end connectors secured to the manifold and to the tubular bolts and joined to the opposite ends of a flexible hose to accommodate the pivotal movement.

13. In the apparatus of claim 12 wherein said mainfold has top wall supply ports, said flexible hose extending between the cylinder elements and the bracket means and then outwardly to the tubular bolts.

14. In the apparatus of claim 12 wherein said mainfold unit includes a pivot bracket mounted on said pivot shaft means and extending upwardly between a pair of cylinder elements, a manifold secured to the upper end of the pivot bracket and including said output ports, a cover releasably secured to the manifold unit to one side of the cylinder elements to define a housing portion, rigid hydraulic connections between the output ports of the manifold and the cylinder elements within said housing, and said manifold unit being attached to the adjacent cylinder elements for simultaneous pivotal movement.

15. The apparatus of claim 7 having a trailer locking mechanism including a latch bar pivotally secured to the motor pivot assembly adjacent the upper end of said bracket means and between a pair of said cylinder elements, a control linkage pivotally mounted to the motor pivot assembly, a resilient means coupled to the control linkage and to the latch bar and defining an overcenter mounting of the latch bar, said linkage being movable to release the latch bar.

16. In the apparatus of claim 15 wherein said latch bar has a side wall having an L-shaped slot with a long portion generally parallel to the bar and a short leg portion angularly transverse of the bar, a control shaft pivotally mounted in the motor pivot assembly, a coupling link secured to control shaft and having a pin on the outer end located in said slot, a spring means connected between the outer end portion of the latch bar and said pin to define an over-center positioning of the pin in said slot.

17. The apparatus of claim 16 wherein said manifold unit is located beneath said latch bar and is coupled to the cylinder elements for pivoting therewith, said manifold unit includes a pivot bracket mounted on said pivot shaft means and extending upwardly between a pair of cylinder elements, a manifold secured to the upper end of the bracket, a cover releasably secured to the manifold unit to one side of the cylinder elements to define a housing portion, and rigid hydraulic connections between the manifold and the cylinder element within said housing.

18. In the apparatus of claim 16 including trim stop means including a pair of cam plates pivotally mounted on a cam shaft one each adjacent each of said side bar members, a lever connected to said cam shaft, said cam plates having a plurality of steps defining offset stops selectively aligned with an outboard element.

19. The apparatus of claim 7 including a trim stop means pivotally located between said side bar members and including a positioning lever to the exterior of one side bar member for selective positioning of the stop means in the path of an outboard motor element.

20. In the outboard motor mounting apparatus of claim 19 wherein said trim stop means includes a pair of cam plates pivotally mounted on a cam shaft one each adjacent each of said side bar members, said positioning lever connected to said cam shaft, said cam plates having a plurality of steps defining offset stops selectively aligned with said motor element.

21. The apparatus of claim 7 wherein each of said cylinder elements include a double wall cylinder defining a piston chamber and having an inner and an outer wall means spaced to form a transfer passage between said wall means, a supply closure head secured to one end of said cylinder and having a first radial supply port connected to the transfer passage, the outer end of the cylinder having an outer flat head mounted on the outer wall means with lateral passages between the transfer passageway and the piston chamber at the inner face of said outer flat head, a second radial supply port in said supply closure head having a lateral passage at the inner face of said supply closure head, and a valved piston unit in said cylinder chamber having a piston rod extended through a sliding seal means in said outer flat head to provide a maximum working stroke, said radial supply ports being connected to said manifold.

22. In the apparatus of claim 21 wherein said supply closure head is cup-shaped and includes a sidewall telescoped over the lower end of said double wall cylinder, a first supply port connected in the sidewall of said closure head and terminating in an annular passageway aligned with said transfer passageway, and a second supply port connected in the sidewall of said closure head and terminating in the lower end of said piston chamber.

23. The apparatus of claim 22 wherein said manifold unit includes a pivot bracket mounted on said pivot shaft means and extending upwardly between a pair of cylinder elements, a manifold secured to the upper end of the bracket and having said supply ports and said output ports, a cover releasably secured to the manifold unit to one side of the cylinder elements to define a housing portion, rigid hydraulic connections between said output ports and the cylinder elements within said housing.

24. An outboard motor mounting apparatus, comprising a generally rectangular clamp bracket assembly having a pair of parallel vertical side bar members connected at the upper end of a motor pivot assembly, a motor swivel bracket pivotally attached to the upper end of the side bar members, tubular mounting bolts, passing through said side members, a pair of piston-cylinder power and shock absorbing means each having a cylinder element and a piston rod element and located in side-by-side spaced relation between said side members, a bracket pivot support means including a pivot shaft means secured to the lower end of the side members and connected to said cylinder elements, said piston rod elements having a motor pivotal support plate means adapted to be secured to said motor swivel bracket adjacent the upper end of the side members, each of said cylinder elements includes a double wall cylinder defining a piston chamber and having an inner end and an outer wall means spaced to form a transfer passageway between said wall means and having a supply closure head secured to one end of said cylinder and having a first radial supply port connected to the transfer passageway, the outer end of the cylinder having a flat head mounted on the walls with lateral passages between the transfer passageway and the piston chamber at the inner face of said supply closure head, and a valved piston unit in said cylinder chamber having a piston rod extended through a sliding seal means in said outer head to provide a maximum working stroke, a hydraulic manifold unit pivotally mounted on the bracket pivot support means between the lower ends of the cylinders and connected to the adjacent cylinders, said manifold unit having a pair of input ports and including a protective chamber having first and second pairs of output ports, connecting hose means within the chamber connecting the manifold to the cylinder heads, hose means connected one each between said input ports and the outer end of each of said tubular mounting bolts, a pump means connected to the inner end of one of said bolts, and a reservoir connected to the inner end of the other of said bolts.

25. The apparatus of claim 24 having a trailer locking mechanism including a latch bar pivotally secured to said swivel bracket adjacent the upper end of said swivel bracket, a control linkage pivotally mounted to the swivel bracket, resilient spring means coupled to the control linkage and to the latch bar and defining an over-center mounting of the latch bar latching the latch bar between a position adjacent the swivel bracket and an angulated outward position, said linkage being movable to release and move the latch bar from either of said two positions, and trim stop means including a pair of cam plates pivotally mounted on a shaft one each adjacent each of said side bar members, a lever being connected to said shaft, said cam plates having a plurality of steps defining offset stops selectively aligned with said swivel bracket.

26. A combined power actuating and shock absorbing piston-cylinder unit, comprising a double wall cylinder defining a piston chamber and having an inner and an outer wall means spaced to form a transfer passage between said wall means, a supply closure head secured to one end of said cylinder and having an extended portion over the cylinder and having a first radial supply port in said extended portion having an input end for connection to a supply and an output end terminating in the transfer passage, said closure head having a pivot means axially outwardly of the cylinder, an outer plug head mounted within the opposite end of the cylinder from said supply closure head, said piston-cylinder unit having a piston in said piston chamber and movable between a retracted position adjacent the closure head and an expanded position adjacent the plug head, lateral passages between the transfer passage and the piston chamber at the inner face of said plug head, said supply closure head having an essentially flat inner face adjacent the piston in the fully retracted position of the piston, a second radial supply port in said supply closure head having a lateral passage at the inner face of said supply closure head for supplying liquid radially into the cylinder adjacent the inner face to produce maximum length of the cylinder between said closure head and plug head, wherein said piston comprises a valved piston unit in said piston chamber having a piston rod extended through a sliding seal means in said plug head.

27. In the outboard motor mounting apparatus of claim 26 wherein said supply closure head is cup-shaped and is telescoped over the lower end of said double wall cylinder portion, said first supply port connected in the side of said supply closure head and terminating in an annular passageway, said second supply port connected in the side of said supply closure head and terminating in the lower end of said piston chamber.

28. In an outboard motor mounting apparatus a swivel bracket assembly having a pivotal motor support, a trailing locking mechanism including an elongated bar member pivotally mounted at one end to said motor support, a control linkage connected to said bar for manual positioning of the bar member, and a resilient means connected to said bar member and forming an over-center mounting of said bar member for holding said bar member in a retract release position adjacent the bracket assembly and in an extended latch position extending outwardly and downwardly from the bracket assembly.

29. In the outboard motor mounting apparatus of claim 28 wherein said latch bar includes a side wall having an L-shaped slot with a long portion extending generally parallel to the bar and a short leg portion angularly transverse of the bar, a control shaft pivotally mounted in the bracket assembly, a coupling link secured to control shaft and having a pin on the outer end located in said slot, a spring means connected between the outer end portion of the latch bar and said pin to define an over-center positioning of the pin in said slot.

30. In an outboard motor mounting apparatus having a clamp bracket assembly with depending side members, and including a trim stop means located between said side members of the clamp bracket assembly, said stop means including a stepped edge having a plurality of different sized steps, and including a positioning lever to the exterior of one side member for selective positioning of the stop means with one of said steps in the path of the clamp bracket assembly.

31. In the outboard motor mounting apparatus of claim 30 wherein said trim stop means includes a pair of cam plates each having said stepped edge and pivotally mounted on a shaft one each adjacent each of said side members, said lever being connected to said shaft, each of said cam plates having said stepped edge with said plurality of steps defining offset stops selectively aligned with said clamp bracket assembly.

* * * * *